US011920891B2

(12) United States Patent
Hall

(10) Patent No.: US 11,920,891 B2
(45) Date of Patent: Mar. 5, 2024

(54) PADDLE FOR DISCIPLINE WITH PIVOTING HANDLE AND RELATED METHODS

(71) Applicant: Harold Stuart Hall, Haines City, FL (US)

(72) Inventor: Harold Stuart Hall, Haines City, FL (US)

( * ) Notice: Subject to any disclaimer, the term of this patent is extended or adjusted under 35 U.S.C. 154(b) by 0 days.

(21) Appl. No.: 18/327,431

(22) Filed: Jun. 1, 2023

(65) Prior Publication Data

US 2023/0392895 A1 Dec. 7, 2023

Related U.S. Application Data

(60) Provisional application No. 63/365,618, filed on Jun. 1, 2022.

(51) Int. Cl.
*F41B 15/02* (2006.01)
*A63B 59/40* (2015.01)

(52) U.S. Cl.
CPC ..... *F41B 15/02* (2013.01); *A63B 59/40* (2015.10)

(58) Field of Classification Search
CPC ..... F41B 15/02; A61H 1/008; A61H 23/06; B68B 11/00; A63B 59/40; A63B 2102/00; A63B 2102/08; A63B 2102/16; A63B 2102/20; E05D 11/10; E05D 11/1007; E05D 11/1014; E05D 11/1028; E05D 11/1078; E05D 11/1085; E05D 2011/1035
USPC ..... 16/327, 328, 329, 331, 332
See application file for complete search history.

(56) References Cited

U.S. PATENT DOCUMENTS 1,732,508 A * 10/1929 Farris ..... A46B 5/0033 403/92
2,590,991 A 4/1952 McDonald
2,645,488 A * 7/1953 Jorgenson ..... F41B 15/02 248/909
3,597,861 A * 8/1971 Gordon ..... G09B 19/00 473/565
3,684,925 A 8/1972 Naff, Jr.
D260,408 S * 8/1981 Ruffing ..... D4/120
4,286,352 A * 9/1981 Pittasch ..... E05D 11/1078 16/237
D316,126 S * 4/1991 Poulakis ..... D21/731
(Continued)

FOREIGN PATENT DOCUMENTS

WO WO-2014161035 A1 * 10/2014 ..... A63B 59/55

*Primary Examiner* — Joshua T Kennedy
(74) *Attorney, Agent, or Firm* — Allen, Dyer, Doppelt + Gilchrist, PA

(57) ABSTRACT

A paddle is for corporal discipline. The paddle includes a handle, and a paddle portion having a base, and an elongate flat member extending from the base. The elongate flat member is to be used for striking a subject to be disciplined in the corporal discipline. The paddle also includes a hinge device comprising a first arm coupled to the handle, a second arm coupled to the base, a pivoting hinge coupled between the first arm and the second arm and configured to switch the paddle portion between a locked state where the paddle portion and the handle are substantially parallel and a folded state where the paddle portion and the handle freely move, and a settable feature. The settable feature selectively changes a threshold pivoting force of the pivoting hinge for causing the paddle portion to switch from the locked state to the folded state.

20 Claims, 8 Drawing Sheets

(56) References Cited

U.S. PATENT DOCUMENTS

| | | | | |
|---|---|---|---|---|
| 5,374,055 | A * | 12/1994 | Tung | A63B 63/083 473/485 |
| D354,789 | S | 1/1995 | Meehan | |
| 7,281,289 | B1 * | 10/2007 | Mirza | A46B 5/0083 15/167.1 |

* cited by examiner

PADDLE FOR DISCIPLINE WITH PIVOTING HANDLE AND RELATED METHODS

RELATED APPLICATION

This application is based upon prior filed copending Application No. 63/365,618 filed Jun. 1, 2023, the entire subject matter of which is incorporated herein by reference in its entirety.

TECHNICAL FIELD

The present disclosure relates to the field of corporal discipline devices, and, more particularly, to a paddle for discipline and related methods.

BACKGROUND

Disciplinary measures have evolved over the years within society. In particular, disciplinary measures in school environments have undergone dramatic changes in the last few decades. In the past, corporal punishment was a primary tool for dispensing discipline in the academic environment. Currently, corporal punishment is no longer widely adopted in most academic environments. One of the major drawbacks to corporal punishment has been the difficulty in applying it in a safe and consistent manner.

SUMMARY

Generally speaking, a paddle is for corporal discipline. The paddle includes a handle, and a paddle portion comprising a base, and an elongate flat member extending from the base. The elongate flat member is to be used for striking a subject to be disciplined in the corporal discipline. The paddle also includes at least one hinge device comprising a first arm coupled to the handle, a second arm coupled to the base, a pivoting hinge coupled between the first arm and the second arm and configured to switch the paddle portion between a locked state where the paddle portion and the handle are substantially parallel and a folded state where the paddle portion and the handle freely move, and a settable feature. The settable feature selectively changes a threshold pivoting force of the pivoting hinge for causing the paddle portion to switch from the locked state to the folded state.

In some embodiments, the at least one hinge device may include a tension ball catch hinge. One of the first arm and the second arm may include a ball catch end, and the other one of the first arm and the second arm may include a tongue end. The settable feature may include a set screw carried by the ball catch end.

More specifically, the handle may include a first proximal hilt portion, a medial elongate portion for gripping by a user, and a distal flanged head coupled to the medial elongate portion. The medial elongate portion may include a wrap therearound. The at least one hinge device may include first and second hinge devices aligned with each other.

The elongate flat member may include a radiused distal end opposite the base. The elongate flat member may include a composite of cellulose fiber, for example. The elongate flat member may have a width greater than a width of the handle. The elongate flat member may include an inset felt strike target.

Another aspect is directed to a method for making a paddle for corporal discipline. The method includes forming a handle, and forming a paddle portion. The paddle portion comprises a base, and an elongate flat member extending from the base. The elongate flat member is to be used for striking a subject to be disciplined in the corporal discipline. The method further includes coupling at least one hinge device between the handle and the base. The at least one hinge device includes a first arm coupled to the handle, a second arm coupled to the base, and a pivoting hinge coupled between the first arm and the second arm. The pivoting hinge is configured to switch the paddle portion between a locked state where the paddle portion and the handle are substantially parallel and a folded state where the paddle portion and the handle freely move, and a settable feature. The settable feature selectively changes a threshold pivoting force of the pivoting hinge for causing the paddle portion to switch from the locked state to the folded state.

DETAILED DESCRIPTION

Figure 1:
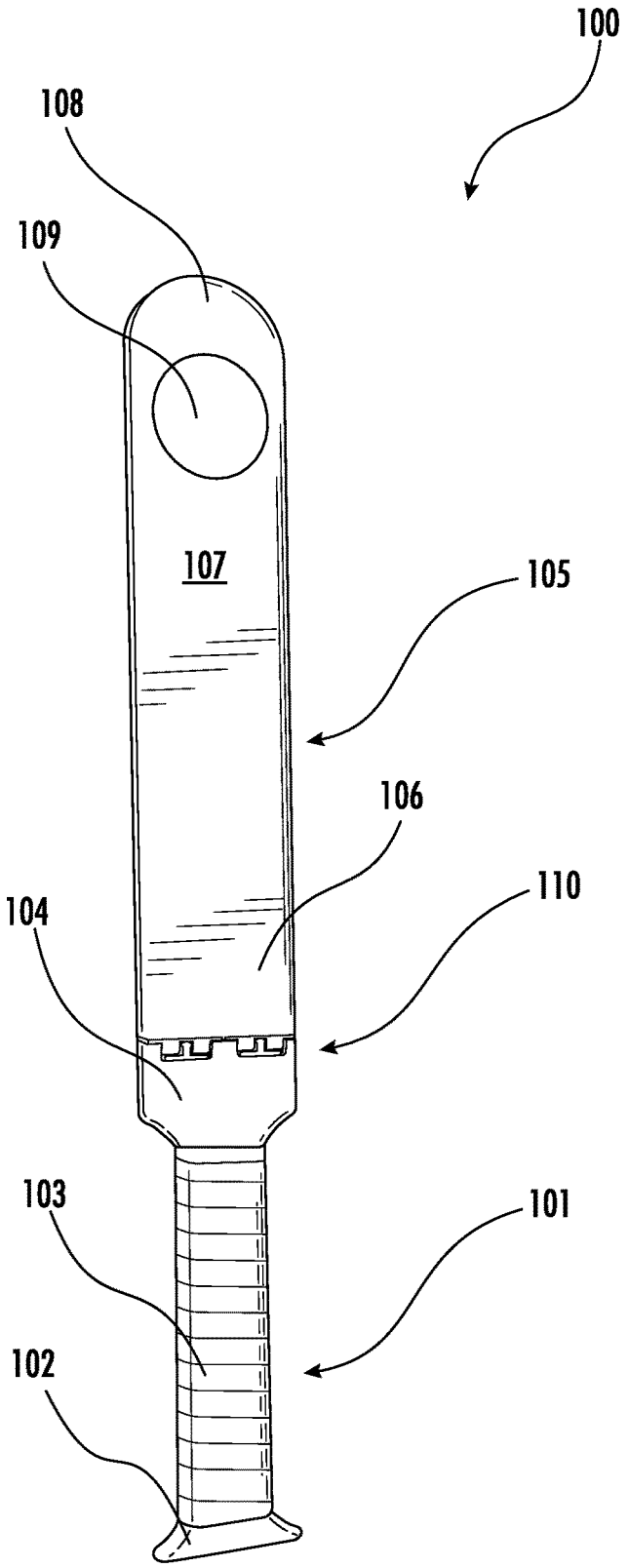
FIG. 1 is a top plan schematic view of a paddle in a locked state, according to the present disclosure.
Figure 2:
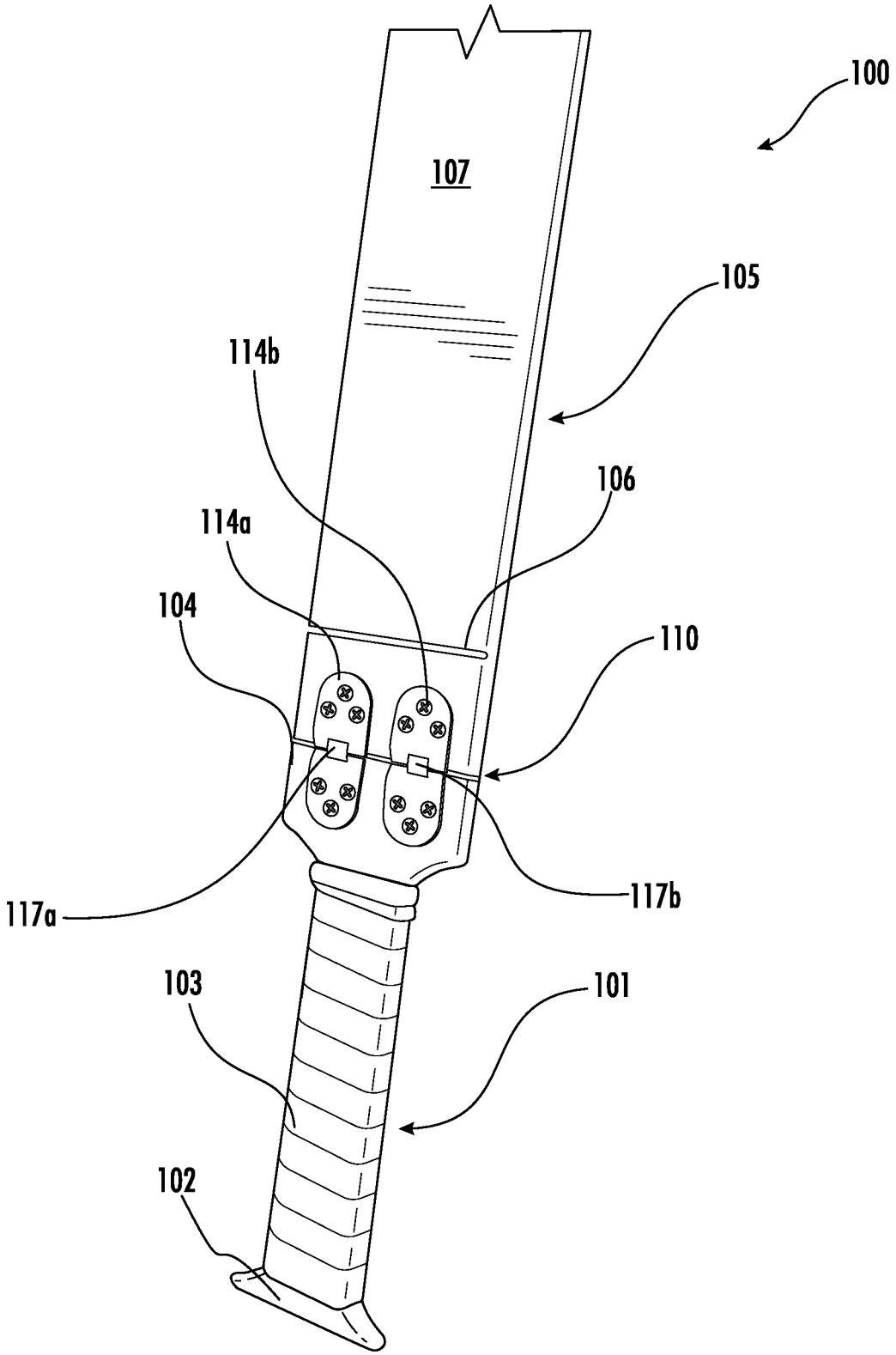
FIG. 2 is a bottom perspective schematic view of the paddle from FIG. 1 in the locked state.
Figure 3:
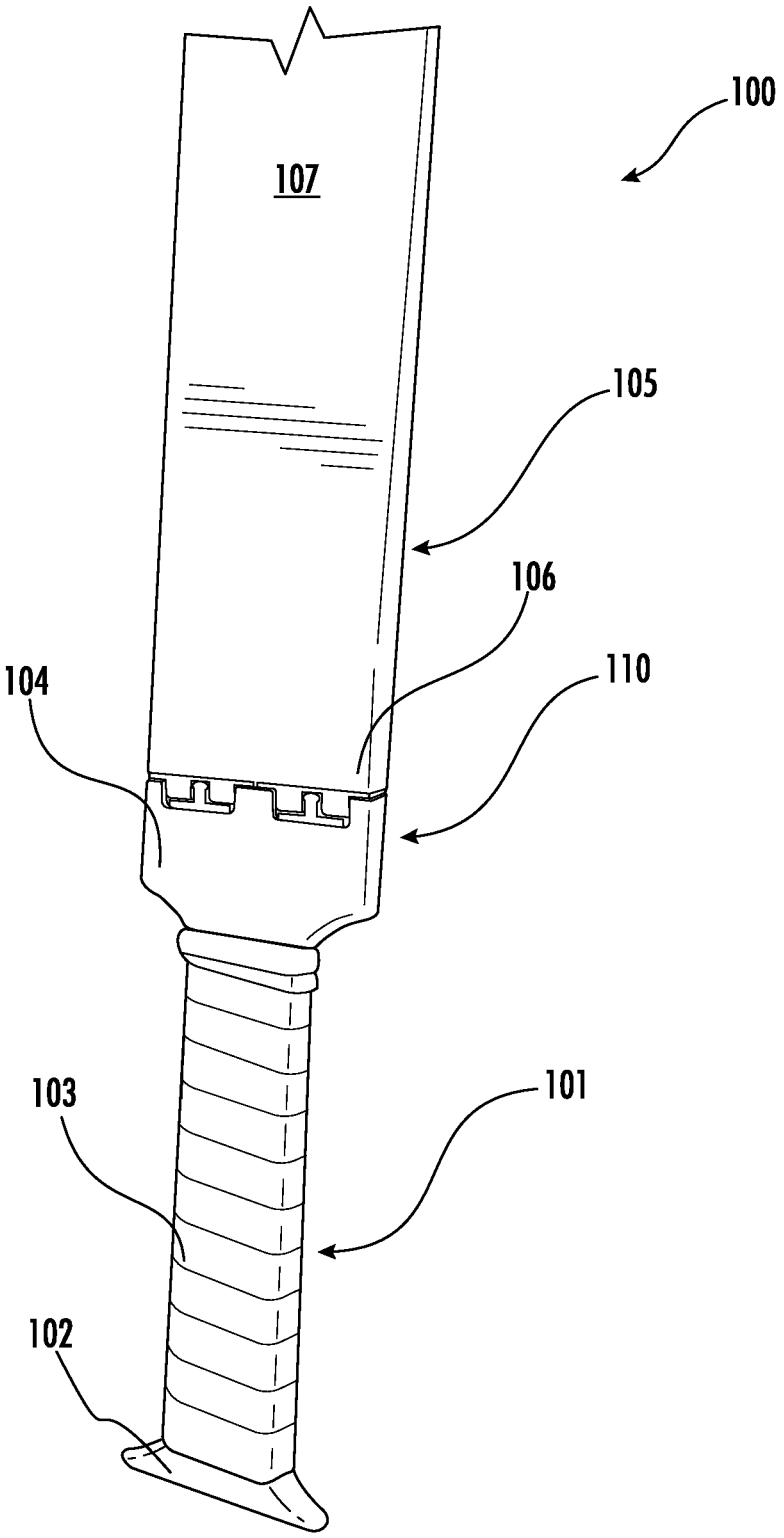
FIG. 3 is a top perspective schematic view of the paddle from FIG. 1 in the locked state.
Figure 4:
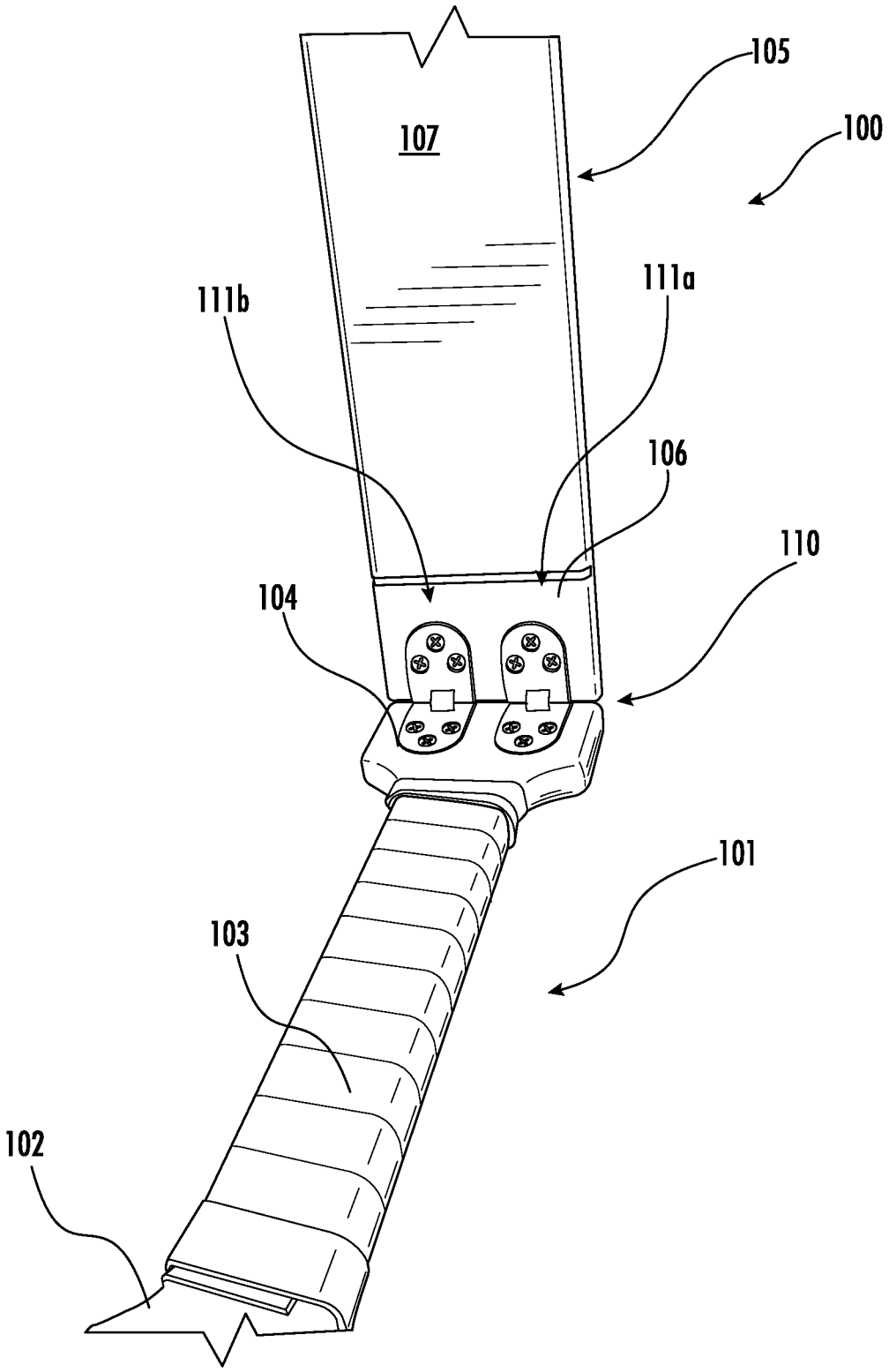
FIG. 4 is a bottom perspective schematic view of the paddle from FIG. 1 in a folded state.
Figure 5:
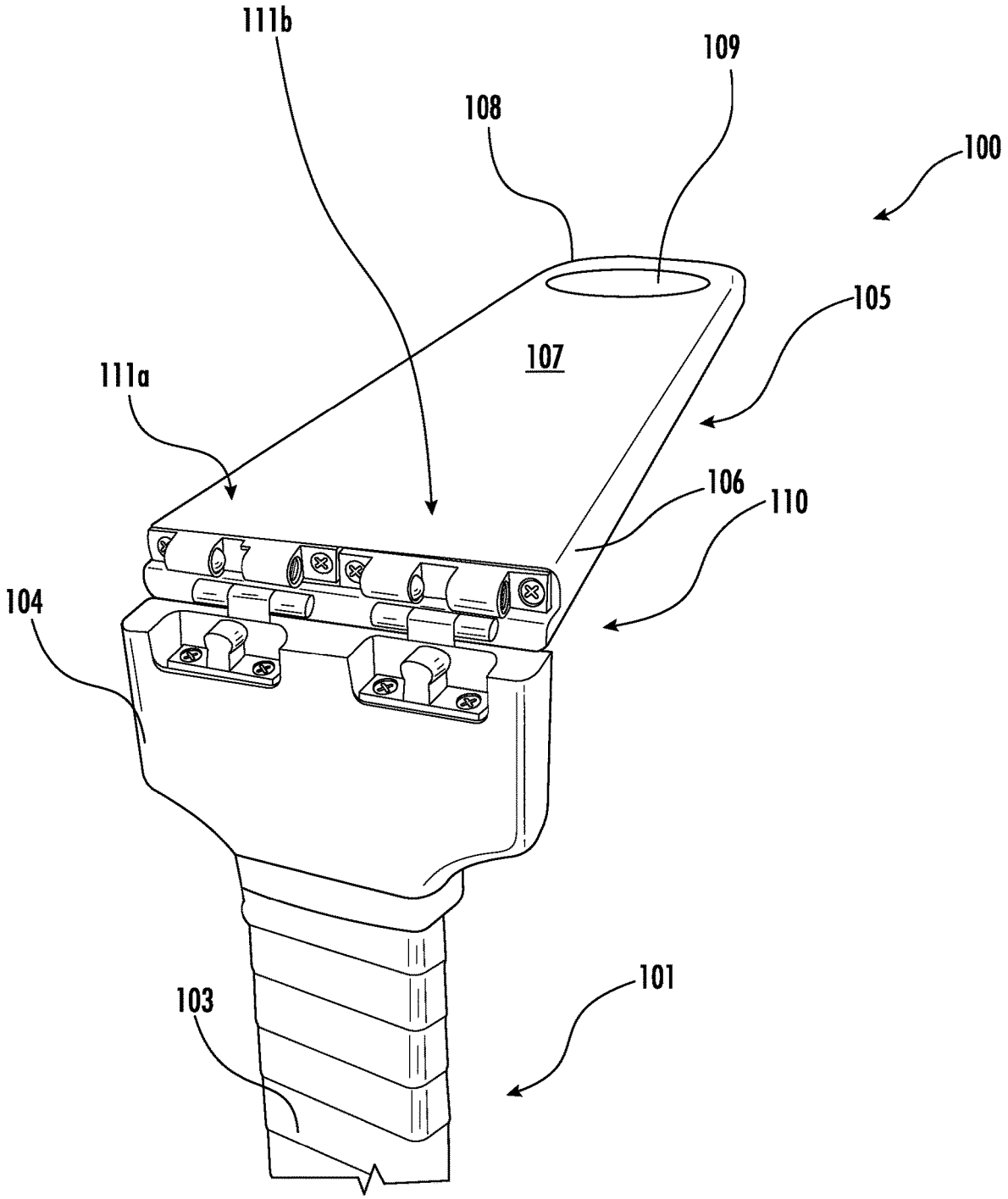
FIG. 5 is a top perspective schematic view of the paddle from FIG. 1 in the folded state.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Referring to FIGS. 1-6 & 7A-7B, a paddle 100 according to the present disclosure is now described. As will be appreciated, the paddle 100 is for application of corporal discipline to a subject to be disciplined. The paddle 100 comprises a handle 101. The handle 101 illustratively includes a first proximal hilt portion 102, which is proximal to the user, a medial elongate portion 103 for gripping by a user, and a distal flanged head 104 coupled to the medial elongate portion. As perhaps best seen in FIGS. 1-2, the distal flanged head 104 has a width greater than a width of the medial elongate portion 103. The medial elongate portion 103 illustratively comprises a leather strap wrapped therearound, and a plurality of fasteners (e.g. staples, pins, adhesive) coupling the leather strap thereto. The medial elongate portion 103 may comprise a fabric wrap (e.g. adhesive backed fabric tape) around it to provide some cushion to the user. The fabric strap may be in addition or in alternative to the leather strap.

The paddle 100 comprises a paddle portion 105 comprising a base 106, and an elongate flat member 107 extending from the base. The elongate flat member 107 is illustratively rectangle shaped with rounded corners, and has substantially parallel sides. Of course, in other embodiments, the elongate flat member 107 may have other shapes, such as oval shaped. In yet other embodiments, the elongate flat member 107 may alternatively not be entirely flat and may comprise a rounded rod in shape.

The elongate flat member 107 illustratively comprises a radiused distal end 108 for avoiding injury to the subject to be disciplined. Also, the elongate flat member 107 comprises an inset felt strike target 109, providing the user guidance as to strike zone and swing direction. As will be appreciated, the elongate flat member 107 is to be used for striking the subject to be disciplined during the corporal discipline.

Figure 6:
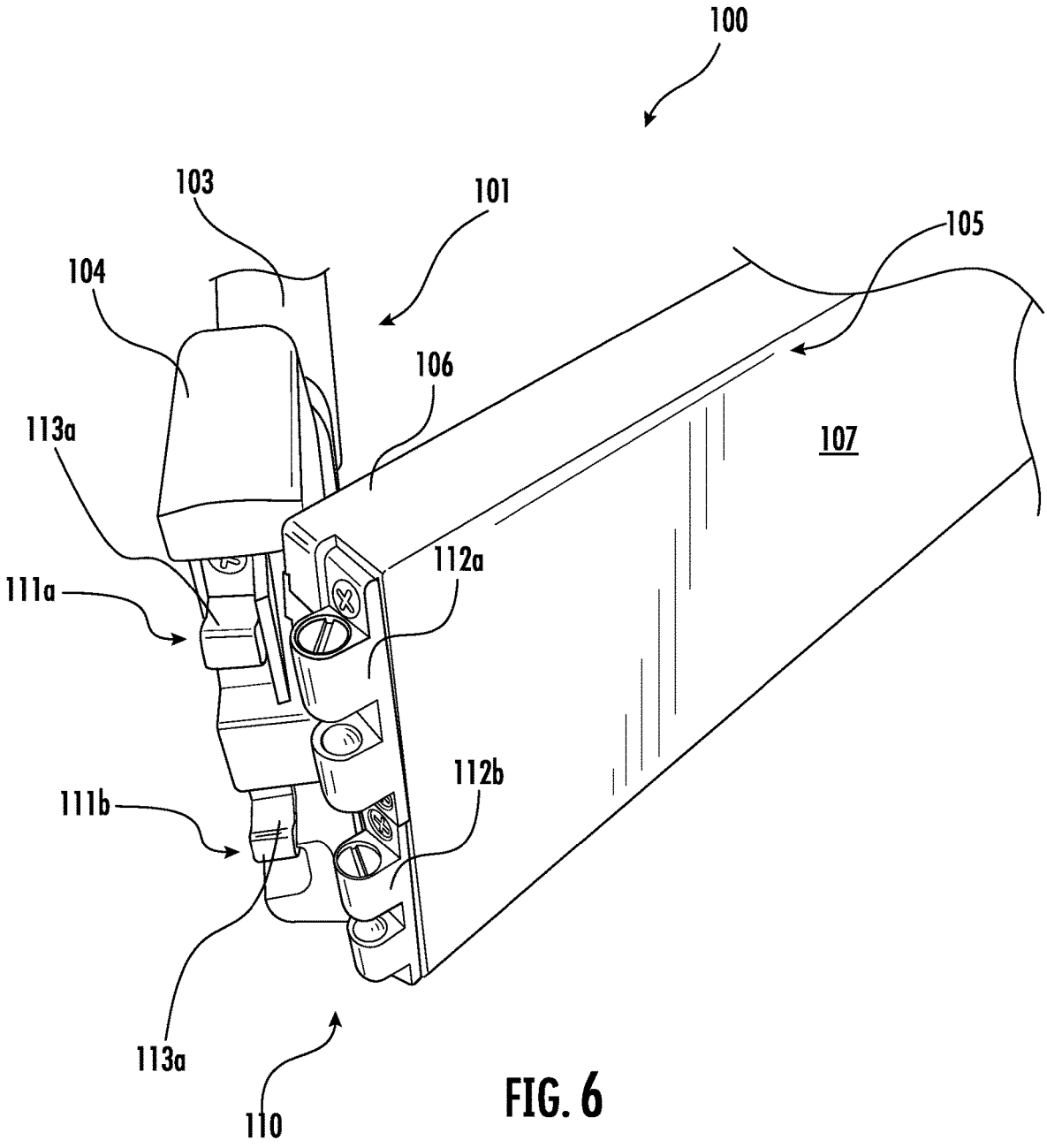
FIG. 6 is another top perspective schematic view of the paddle from FIG. 1 in the folded state.

As perhaps best seen in FIG. 6, the paddle 100 illustratively comprises a hinge 110 coupled between the distal flanged head 104 of the handle 101 and the base 106. The hinge 110 comprises first and second aligned pivoting hinges 114*a*-114*b* on a backside, and first and second aligned double tension ball catches 111*a*-111*b* on the front side adjacent the inset felt strike target 109. Each double tension ball catch 111*a*-111*b* comprises a double ball catch end 112*a*-112*b* coupled to the base 106, and a tongue end 113*a*-113*b* coupled to the distal flanged head 104. Of course, in other embodiments, the arrangement of the double ball catch end 112*a*-112*b* and the tongue end 113*a*-113*b* may be reversed.

Also, in some embodiments, the hinge 110 comprises a first and second aligned single ball catch hinges, or any hinge capable of resisting pivoting unless a sufficient torque force is applied. In particular, the hinge 110 causes the paddle portion 105 to pivot freely when the applied force exceeds a threshold force. The threshold force may comprise 10 pounds of force (i.e. about 44 Newtons of force).

In some embodiments, the threshold force of the hinge 110 may be selectively set by the user. Helpfully, the user may adjust the maximum applied force to the subject to be disciplined based upon an age of the subject. For example, the hinge 110 may comprise a settable torque hinge in some embodiments. In the illustrated embodiment, each double tension ball catch 111*a*-111*b* comprises a set screw 115*a*-115*b* for setting the threshold force. As will be appreciated, when the user actuates (i.e., tightens) the set screw 115*a*-115*b*, the retention pressure of the adjacent ball catch is increased, thereby increasing the threshold force needed to cause the hinge 110 to swing to the folded state. Also, when the user releases (i.e., loosens) the set screw 115*a*-115*b*, the retention pressure of the adjacent ball catch is decreased thereby decreasing the threshold force needed to cause the hinge 110 to swing to the folded state, thereby allowing the user to safely lock in the needed force for the discipline.

In the illustrated embodiment, the handle 101, and the paddle portion 105 comprise a wood material or a composite of cellulose fiber (e.g. cypress wood). In other embodiments, the handle 101, and the paddle portion 105 comprise alternatively a polymer material, a fiber glass composite material, or a metallic material, or a combination thereof. Also, the hinge 110 illustratively comprises a metallic material, such as brass.

In particular, when the paddle 100 is used for corporal discipline, the paddle is placed in the first operational state. Here, the hinge 110 is in a locked ("cocked") state holding the handle 101 and the paddle portion 105 in a substantially parallel state (i.e., ±5° from parallel). When the applied force exceeds the threshold force, the hinge 110 pivots and places the paddle 100 in the second folded state, releasing the excess force before application to the subject to be disciplined.

Figure 7A:
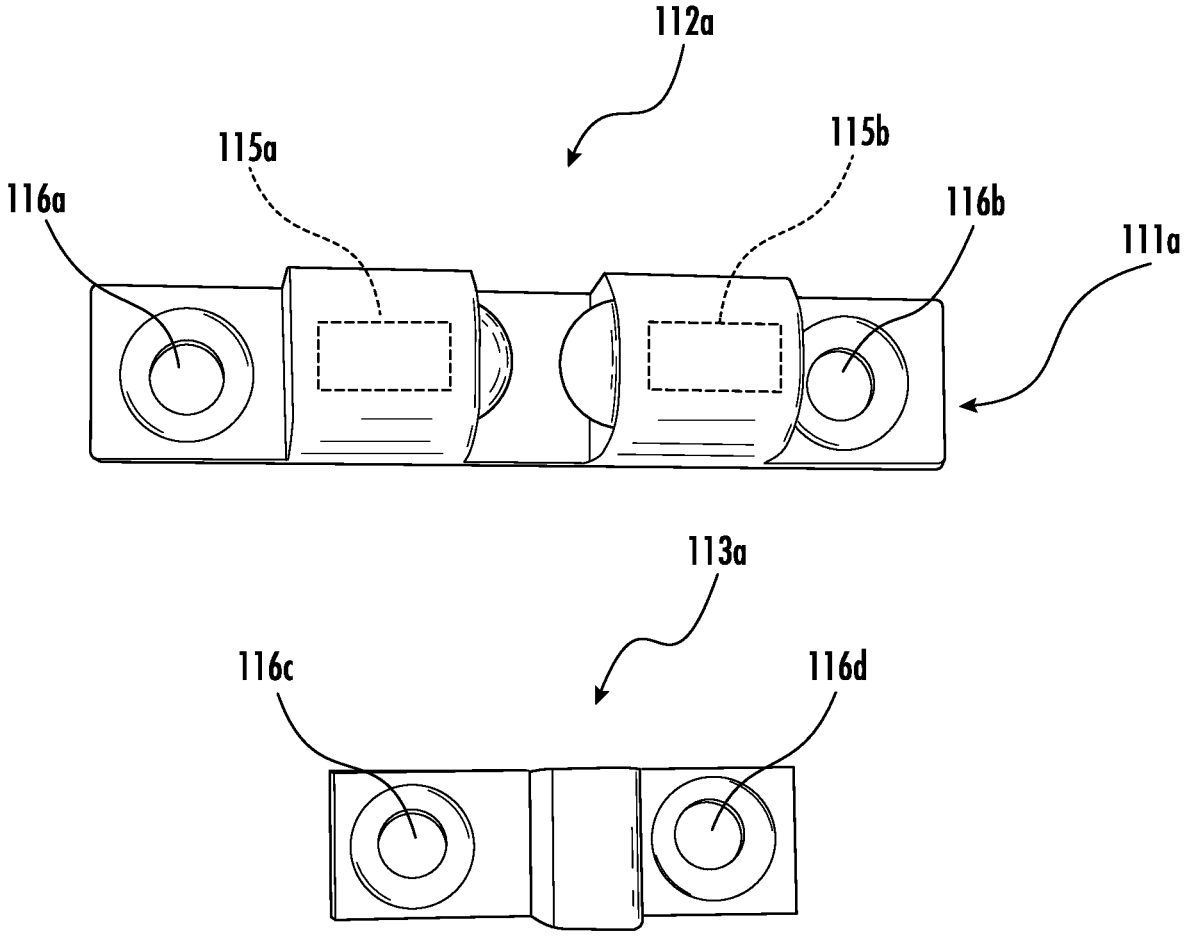
FIG. 7A is a top plan schematic view of the first and second aligned double tension ball catches in an uncoupled state from the paddle of FIG. 1.
Figure 7B:
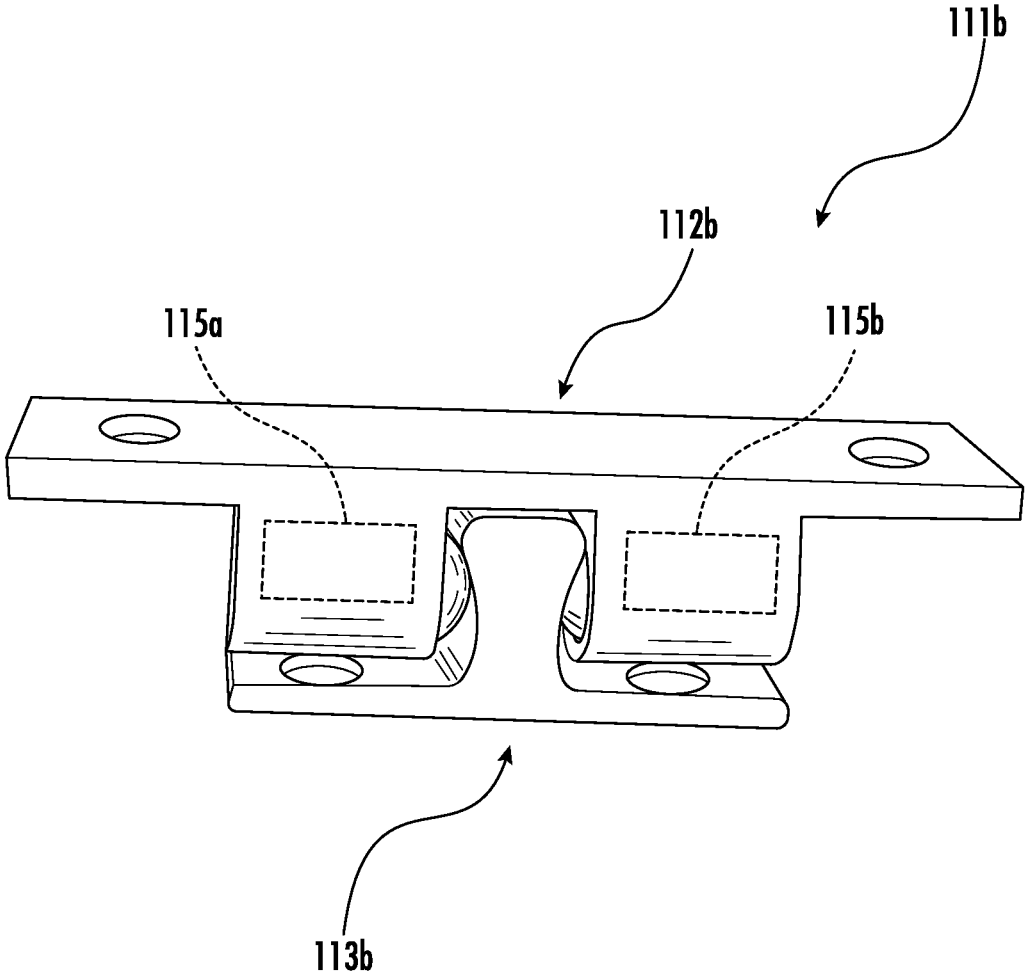
FIG. 7B is a top plan schematic view of the first and second aligned double tension ball catches in a coupled state from the paddle of FIG. 1.

As perhaps best seen in FIG. 7A, each double ball catch end 112*a*-112*b* and the tongue end 113*a*-113*b* comprises a plurality of fastener receiving openings 116*a*-116*d* for respectively receiving fasteners. In the illustrated example embodiment, the fasteners are threaded screws.

Another aspect is directed to a method for making a paddle 100 for corporal discipline. The method comprises forming a handle 101, and forming a paddle portion 105 comprising a base 106, and an elongate flat member 107 extending from the base. The elongate flat member 107 is to be used for striking a subject to be disciplined in corporal discipline. The method also includes coupling a hinge 110 between the handle 101 and the base 106. The hinge 110 comprises a double tension ball catch, and the hinge causes the paddle portion 105 to pivot freely when an applied force exceeds a threshold.

Yet another is directed to a paddle 100 is for corporal discipline. The paddle 100 includes a handle 101, and a paddle portion 105 comprising a base 106, and an elongate flat member 107 extending from the base. The elongate flat member 107 is to be used for striking a subject to be disciplined in the corporal discipline. The paddle 100 also includes at least one hinge device 110 comprising a first arm 113*a*-113*b* coupled to the handle 101, a second arm 112*a*-112*b* coupled to the base 106, a pivoting hinge 117*a*-117*b* coupled between the first arm and the second arm and configured to switch the paddle portion 105 between a locked state where the paddle portion and the handle are substantially parallel and a folded state where the paddle portion and the handle freely move, and a settable feature 115*a*-115*b*. The settable feature 115*a*-115*b* selectively changes a threshold pivoting force of the pivoting hinge 117*a*-117*b* for causing the paddle portion 105 to switch from the locked state to the folded state.

Another aspect is directed to a method for making a paddle 100 for corporal discipline. The method includes forming a handle 101, and forming a paddle portion 105. The paddle portion 105 comprises a base 106, and an elongate flat member 107 extending from the base. The elongate flat member 107 is to be used for striking a subject to be disciplined in the corporal discipline. The method further includes coupling at least one hinge device 110 between the handle 101 and the base 106. The at least one hinge device 110 includes a first arm 113*a*-113*b* coupled to the handle 101, a second arm 112*a*-112*b* coupled to the base 106, and a pivoting hinge 117*a*-117*b* coupled between the first arm and the second arm. The pivoting hinge 117*a*-117*b* is configured to switch the paddle portion 105 between a locked state where the paddle portion and the handle 101 are substantially parallel and a folded state where the paddle portion and the handle freely move, and a settable feature 115*a*-115*b*. The settable feature 115*a*-115*b* selectively changes a threshold pivoting force of the pivoting hinge 117*a*-117*b* for causing the paddle portion 105 to switch from the locked state to the folded state.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A paddle for corporal discipline, the paddle comprising:
a handle;
a paddle portion comprising
a base, and
an elongate flat member extending from the base, the elongate flat member to be used for striking a subject to be disciplined in the corporal discipline; and
at least one hinge device comprising
a first arm coupled to the handle,
a second arm coupled to the base,
a pivoting hinge coupled between the first arm and the second arm and having a tongue and catch feature, one of the first arm and the second arm comprising a catch end, the other one of the first arm and the second arm comprising a tongue end, the pivoting hinge configured to switch the paddle portion from a locked state where the paddle portion and the handle are substantially parallel to a folded state where the paddle portion and the handle freely move when a threshold pivoting force is exceeded, and
a settable feature selectively changing the threshold pivoting force of the pivoting hinge for causing the paddle portion to switch from the locked state to the folded state.

2. The paddle of claim 1 wherein the tongue and catch feature comprises a tension ball catch hinge; wherein the catch end comprises a ball catch end; and wherein the settable feature comprises a set screw carried by the ball catch end.

3. The paddle of claim 1 wherein the handle comprises a first proximal hilt portion, a medial elongate portion extending from the first proximal hilt portion and for gripping by a user, and a distal flanged head coupled to the medial elongate portion.

4. The paddle of claim 3 wherein the medial elongate portion comprises a wrap therearound.

5. The paddle of claim 1 wherein the at least one hinge device comprises first and second hinge devices aligned with each other.

6. The paddle of claim 1 wherein the elongate flat member comprises a radiused distal end opposite the base.

7. The paddle of claim 1 wherein the elongate flat member comprises a composite of cellulose fiber.

8. The paddle of claim 1 wherein the elongate flat member has a width greater than a width of the handle.

9. The paddle of claim 1 wherein the elongate flat member comprises an inset felt strike target.

10. A paddle for corporal discipline, the paddle comprising:
a handle comprising
a first proximal hilt portion,
a medial elongate portion extending from the first proximal hilt portion and for gripping by a user, and
a distal flanged head coupled to the medial elongate portion;
a paddle portion comprising
a base, and
an elongate flat member extending from the base, the elongate flat member to be used for striking a subject to be disciplined in the corporal discipline; and
at least one tension ball catch hinge device comprising
a first arm coupled to the distal flanged head of the handle,
a second arm coupled to the base, one of the first arm and the second arm comprising a ball catch end, the other one of the first arm and the second arm comprising a tongue end,
a pivoting hinge coupled between the first arm and the second arm and configured to switch the paddle portion between a locked state where the paddle portion and the handle are substantially parallel and a folded state where the paddle portion and the handle freely move, and
a set screw carried by the ball catch end and selectively changing a threshold pivoting force of the pivoting hinge for causing the paddle portion to switch from the locked state to the folded state.

11. The paddle of claim 10 wherein the medial elongate portion comprises a wrap therearound.

12. The paddle of claim 10 wherein the at least one tension ball catch hinge device comprises first and second tension ball catch hinge devices aligned with each other.

13. The paddle of claim 10 wherein the elongate flat member comprises a radiused distal end opposite the base.

14. The paddle of claim 10 wherein the elongate flat member comprises a composite of cellulose fiber.

15. The paddle of claim 10 wherein the elongate flat member has a width greater than a width of the handle.

16. The paddle of claim 10 wherein the elongate flat member comprises an inset felt strike target.

17. A method for making a paddle for corporal discipline, the method comprising:
forming a handle;
forming a paddle portion comprising
a base, and
an elongate flat member extending from the base, the elongate flat member to be used for striking a subject to be disciplined in the corporal discipline;
coupling at least one hinge device between the handle and the base, the at least one hinge device comprising
a first arm coupled to the handle,
a second arm coupled to the base,
a pivoting hinge coupled between the first arm and the second arm and having a tongue and catch feature, one of the first arm and the second arm comprising a catch end, the other one of the first arm and the second arm comprising a tongue end, the pivoting hinge configured to switch the paddle portion from a locked state where the paddle portion and the handle are substantially parallel to a folded state where the paddle portion and the handle freely move when a threshold pivoting force is exceeded, and
a settable feature selectively changing the threshold pivoting force of the pivoting hinge for causing the paddle portion to switch from the locked state to the folded state.

18. The method of claim 17 wherein the tongue and catch feature comprises a tension ball catch hinge; wherein the catch end comprises a ball catch end; and wherein the settable feature comprises a set screw carried by the ball catch end.

19. The method of claim 17 wherein the handle comprises a first proximal hilt portion, a medial elongate portion extending from the first proximal hilt portion and for gripping by a user, and a distal flanged head coupled to the medial elongate portion.

20. The method of claim 19 wherein the medial elongate portion comprises a wrap therearound.

* * * * *